United States Patent [19]

Aschberger et al.

[11] Patent Number: 4,656,933

[45] Date of Patent: Apr. 14, 1987

[54] WATER-CARBONIZING SYSTEM

[75] Inventors: Matthias Aschberger; Karlheinz Färber, both of Giengen; Anton Deininger, Bachhagel, all of Fed. Rep. of Germany

[73] Assignees: The Coca-Cola Company, Atlanta, Ga.; Bosch-Siemens Hausgeräte GmbH, Munich, Fed. Rep. of Germany

[21] Appl. No.: 768,217

[22] Filed: Aug. 22, 1985

[30] Foreign Application Priority Data

Aug. 22, 1984 [DE] Fed. Rep. of Germany ..... 3430950

[51] Int. Cl.[4] ..... B01F 3/04

[52] U.S. Cl. ..... 99/323.1; 222/129.4; 261/DIG. 7; 426/477

[58] Field of Search ..... 99/275, 323.1, 323.2; 261/DIG. 7; 426/477; 222/129.1, 129.4

[56] References Cited

U.S. PATENT DOCUMENTS 2,576,443 11/1951 Brandstrom ..... 261/DIG. 7
3,618,905 11/1971 Primus ..... 261/DIG. 7
3,991,219 11/1976 Kuckens ..... 99/275 X
4,497,348 2/1985 Sedam ..... 99/275 X
4,562,013 12/1985 Jeans ..... 261/DIG. 7

*Primary Examiner*—Billy J. Wilhite
*Attorney, Agent, or Firm*—Birch, Stewart, Kolasch & Birch

[57] ABSTRACT

A water-carbonation system having a pressurized tank which is preferably cooled, a water supply and a $CO_2$ gas supply. The $CO_2$ gas supply has a pressure-reducing valve assembly in the supply line. The valve of this assembly is maintained in a closed position by the gas pressure in the tank. However, when this pressure falls below a predetermined limit, the valve will move to an open position to vent the tank to the atmosphere. A signal may be used in conjunction with the valve to notify an operator of the drop in pressure. The valve may also be manually operated to vent the tank. This water-carbonation system can be used in beverage dispensers in which the carbonized water is mixed with beverage concentrates to prepare a beverage that is ready for consumption.

10 Claims, 4 Drawing Figures

WATER-CARBONIZING SYSTEM

BACKGROUND OF THE INVENTION

The invention relates to a water-carbonizing system in a preferably cooled, pressure tank into which water (up to a predetermined level) and $CO_2$ gas (by means of a pressure-reducing valve assembly and a supply line) are introduced as required, and from which the carbonized water is drawn off by means of a closing and pressure-reducing valve.

This type of water-carbonizing system is particularly applied to beverage dispensers in which carbonized water is mixed with beverage concentrates to prepare a beverage that is ready for consumption. To do this, a storage tank is used in which water is enriched with $CO_2$ gas and cooled. In order to ensure a sufficient carbonization of the water, it is necessary, or at least advisable, to carry out the carbonization in the storage tank under high pressure. Toward this end, water is introduced into the storage tank, as required, by means of a liquid-level-dependent unit controlling the quantities of water to be. Also, $CO_2$ gas is introduced by means of a pressure-dependent unit controlling the quantities of gas to be moved. The unit controlling the quantities of water to be moved may be either a pump unit, a control valve if an assured water supply is available subjected to a sufficiently high pressure, or a combination of both. Ordinarily, the unit for controlling the quantities of $CO_2$ gas to be moved is a self-regulating, pressure-reducing valve. Pressure-reducing valves of known construction are able to provide a relatively constant preset gas pressure, provided a higher gas pressure is applied to the inlet side.

Special problems arise in these systems when the storage tank has to be filled anew with water and/or $CO_2$ gas in a volume above the usual intermittent mode of operation. Specifically, when the supply in the $CO_2$ storage cylinder is exhausted and it is necessary to replace this storage cylinder, a pressure drop is present or imminent in the storage tank. This pressure drop leads to an insufficient carbonization of the water. It may also be advisable to provide a pressure drop in the storage tank that will allow maintenance work to be carried out or a malfunction to be remedied under normal atmospheric pressure.

SUMMARY OF THE INVENTION

A major object of the invention is to provide an apparatus that in a simple way signals a drop below a predetermined operating pressure and, in an equally simple fashion, offers the possibility of equalizing the pressure in the storage tank to the level of the atmospheric pressure.

According to the teachings of the invention, a water-carbonizing system in a storage tank which is subjected to an internal pressure higher than atmospheric pressure and which satisfies the above requirements is characterized by the fact that, in the $CO_2$-gas area supplied by the unit controlling the quantities of $CO_2$ gas to be moved, there is provided a valve assembly that can close an outlet opening against a reset force by means of the higher gas pressure.

When applying this technique proposed by the invention, the valve assembly is kept closed against the reset force by the gas pressure which is greater than the reset force and is required for the normal operation. If the gas pressure in the system drops by a prespecified amount and in effect, falls below that of the reset force, the valve assembly opens, triggering a signal transmission. In the simplest form, this can done by adjusting a valve tappet. However, the gas escaping under the low pressure can also be utilized for an acoustic signal transmission, but in addition to bringing out the valve tappet, the valve can also be forcibly opened against the normal work pressure, for instance in order to vent the system.

A spring element can be used as the simplest means for providing the reset force which can be set at a desired value, preferably by means of a set screw.

In a preferred embodiment of the system embodying the invention, a flow throttle is provided in the outlet opening for the $CO_2$ gas that can be closed by the valve assembly. This flow throttle is so designed that within the storage tank—due to the quantity of water flowing in via the unit controlling the quantities to be moved as a result of the flow of gas admitted by the flow throttle, no pressure is built up that would close the valve asembly while, with a subsequent supply of $CO_2$ gas with a substantially higher volume of gas moved per unit time, the internal pressure that has been built up will be able to close the outlet opening by means of the valve assembly.

Therefore, in a first operation the storage tank is to be filled with water up to a given level—measured by appropriate sensors—without elaborate supplementary means and is thereafter to be supplied with $CO_2$ gas.

In a preferred embodiment, the system incorporating the invention is characterized by the fact that the valve assembly is designed as a tappet with a disk-shaped valve plate which—guided in a bore of the valve body—faces a valve seat of the valve body with allowance for axial sliding. Preferably, a packing ring made of an elastically deformable material is interposed between the valve plate and valve seat. The spring element is mounted on the tappet and is supported as a compression spring opposite the valve body and the valve plate. Such a design saves a great deal of space and is functionally reliable. The tappet is guided in the valve body with sufficient clearance so that, when the valve is open, the gas can be exhausted to atmosphere between the tappet and the bore in the valve body. The packing ring made of an elastically deformable material serves as a highly effective seal when the valve is closed. Due to the conical shape of the valve seat, the sealing action can be suitably controlled, if necessary.

According to another embodiment, the system taught by the invention is characterized by the fact that the valve plate is guided as a flow throttle in a bore in the valve body to form a peripheral gap between valve plate and guide bore. Thus, the closing force for the open valve results from the pressure difference acting on the valve and occurring between the internal and external pressures and from the effect of the gas stream.

From a production-engineering and applications-oriented viewpoint, it is advisable to integrate the novel valve assembly into the structural element of the unit controlling the quantities of $CO_2$ gas to be moved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
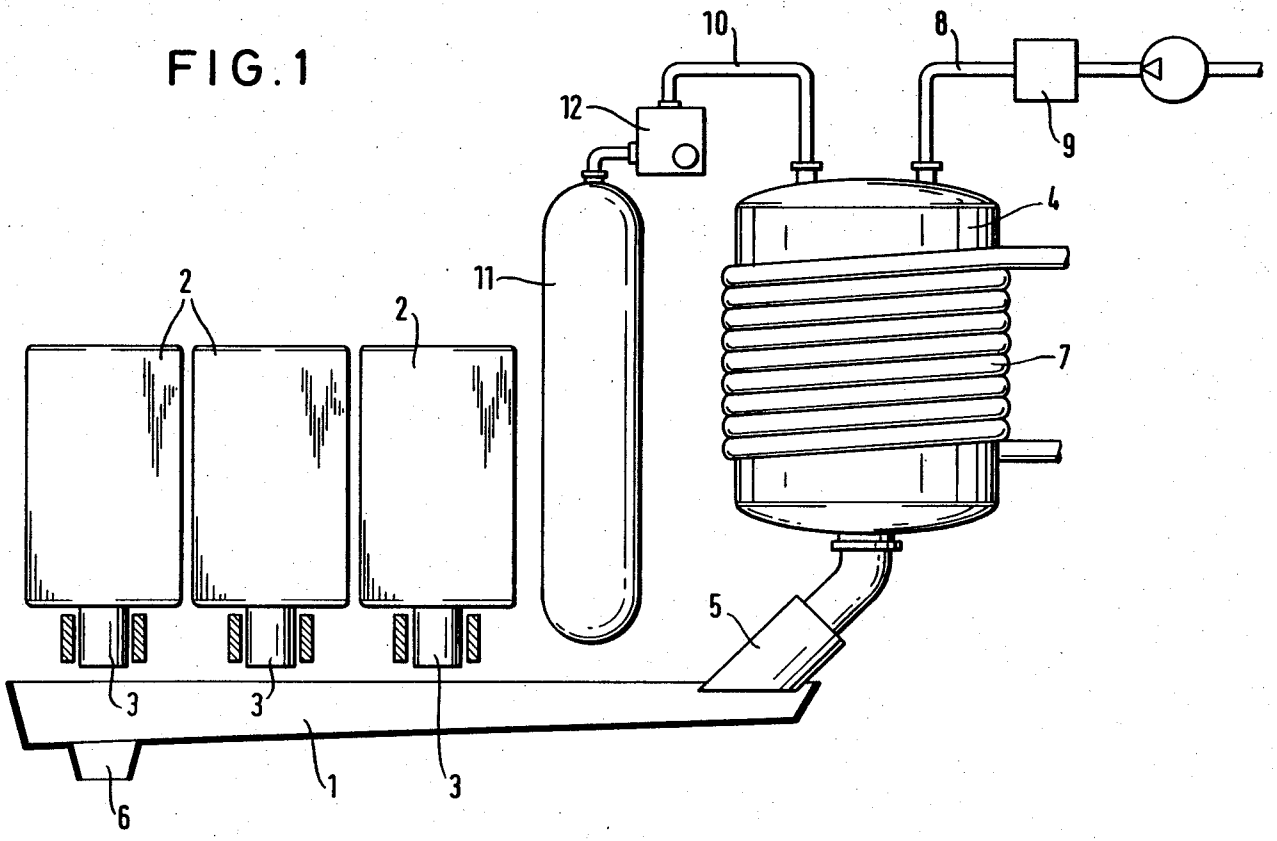
FIG. 1 is a schematic representation of a water-carbonizing system for a beverage dispenser.

A beverage dispenser for the purpose of mixing various beverage concentrates with cooled $CO_2$ water to form a blended beverage includes as constituent elements: a mixing trough 1 in which the mixing process is initiated or carried out, a beverage-concentrate container 2 from which the beverage concentrates are dispensed in portions to the mixing trough 1 by means of dosing units 3, and a storage tank 4 for cooled $CO_2$ water which can flow, as required, into the mixing trough via a dispensing valve 5. The mixture leaves the mixing trough 1 through a discharge funnel 6.

The $CO_2$ water supply is cooled with refrigerants that are passed through a conduit 7 wound around the storage tank 4. The $CO_2$ water in the storage tank 4 is replenished with the amounts drawn off via the dispensing valve 5 by suppling fresh water through a conduit 8 controlled by a valve system 9 and by supplying $CO_2$ gas through a conduit 10 from a tank 11 controlled by a valve system 12.

Due to this $CO_2$ gas, the interior of the tank 4 is subjected to a pressure that is higher than atmospheric pressure, and this contributes to the desired satisfactory carbonization of the water in the storage tank 4. This gage pressure in the storage tank 4 is controlled by a reducing valve that substantially lowers the higher gas pressure in the storage tank 11 to the operating pressure in the carbonizing tank 4.

Figure 2:
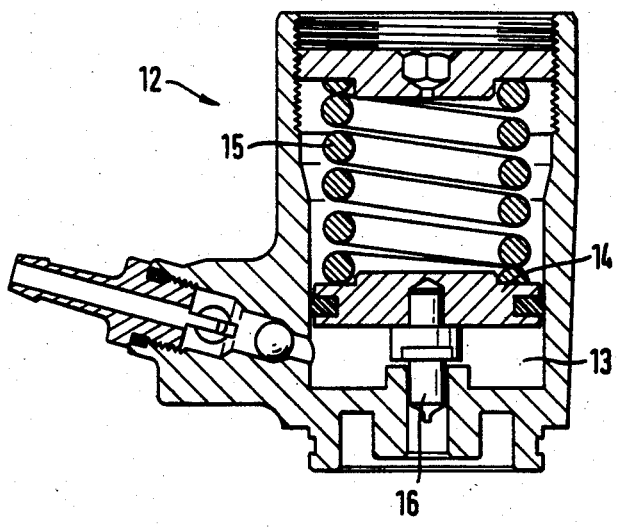
FIGS. 2 and 3 are a simplified illustration of a pressure-dependent device controlling the quantities of $CO_2$ gas to be moved and having a valve assembly which is closed by the operating-gas pressure.
Figure 3:
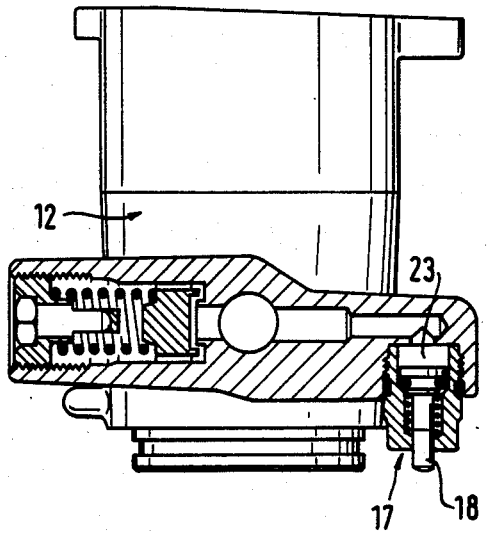

An appropriate device for controlling a cylinder non-return valve is depicted in FIGS. 2 and 3. The gas pressure needed in the carbonizing tank 4 works in a chamber 13 of said valve system 12 by means of a piston 14 against the biasing force of a spring 15. When the gas pressure in the carbonizing tank 4 and, thus, in the valve chamber 13 is reduced, the piston 14 will be pressed downward by the thrust of the spring 15, and a valve not shown herein will be opened by the tappet 16, admitting the flow, or the increased flow, as the case may be, of gas from the storage tank 11. When the gas pressure in the carbonizing tank 4 and, therefore, in the valve chamber 13 increases, it will again lift the piston 14 against the thrust of the spring 15 and the gas-cylinder valve, reacting to the tappet 16, can throttle—or even completely stop—the flow of $CO_2$ gas from the cylinder. Under normal circumstances, this system operates smoothly and reliably as long as there is an adequate gas pressure in the storage cylinder 11.

Figure 4:
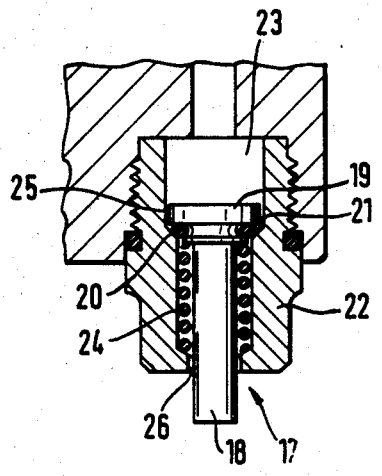
FIG. 4 shows the details of this valve assembly.

However, if the gas pressure in the storage cylinder 11 reaches a limiting value that is no longer sufficient to maintain the operating pressure in the carbonating tank 4 and the supply of $CO_2$ gas; the operator must receive a signal alerting him to this situation. Toward this end, an additional valve assembly 17 is provided in the control valve 12, as illustrated in FIG. 4. This valve assembly 17 is located in the duct system that opens toward the carbonating tank 4. It essentially resembles a non-return valve and has the special feature that the valve-closing element is pressurized by gas in the direction of closing, and opposite thereto by the biasing force of the spring. The valve-closing element contains a valve tappet or stem 18 having a valve piston 19 that operates by means of a packing ring 20 made of elastic material against a valve seat 21 of the valve body 22. If there is sufficient gas pressure in the chamber 23, which also corresponds to the gas pressure in the carbonating tank 4, the piston 19 is held in the closed position against the thrust of an opposing spring 24. However, if the operating pressure in the carbonating tank 4 and, thus, in the chamber 23 drops falls below a given value represented by the force of the spring 24, the piston 19 will react to the force of this spring 24, opening the valve. The residual gas can escape and the position of the tappet 18 indicates that the gas pressure in the system has dropped. The gas escapes through gaps 25, 26 formed between the piston 19 and the tappet on the one hand and the valve body 22 on the other. At least one of these gaps 25 and 26 functions at the same time as a throttle valve, so that a higher gas pressure, which is passed into the chamber 23, closes the valve again.

After the flow of gas from the storage tank 11 is stopped, the valve assembly can also be used to "vent" the carbonating tank 4. For example, this may be necessary whenever a malfunction occurs in the tank or has occurred in the water supply. The gaps 25, 26 of the valve 17 are so designed that the flow of gas corresponding to the admission velocity of the water into the carbonating tank 4 is unhampered to such a degree that no gas pressure develops in the chamber 23 that would close the valve against the thrust of the spring 24. Thus, no problems will arise when the empty carbonating tank 4 again has to be filled up with water or has to be filled or refilled after an interruption or malfunction. If necessary, the reset force of the spring can be changed using an appropriate set screw by means of which the spring 24 is supported opposite the body 22 of the valve system 17.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

We claim:

1. A water carbonation system comprising:

a tank containing gas having a first pressure higher than atmospheric pressure during normal operation and having a second, predetermined pressure during abnormal operation, said second pressure being less than said first pressure;

means for introducing water into the tank and means for introducing $CO_2$ gas into the tank, both said means for introducing permitting carbonation of the water;

means for withdrawing carbonized water from the tank; and a valve assembly associated with said means for introducing $CO_2$ gas, said valve assembly having an aperture and having closure means, said closure means being movable between an open position for permitting release of the gas in the tank through said aperture and a closed position for closing said aperture, said closure means being in the closed position when the tank is at the first pressure and being in the open position when the tank is at the second pressure.

2. The water carbonation system as recited in claim 1 and further comprising:

adjustable spring means having a force for urging said closure means toward the open position, said spring means and the pressure of the gas within the tank normally controlling movement of the closure means.

3. The water carbonation system as recited in claim 2 and further comprising:

flow throttle means provided between the aperture and closure means, said flow throttle means permitting the pressure of the gas introduced by the means for introducing gas to overcome the force of the spring and to move the closure means to the closed position.

4. The water carbonation system as recited in claim 3, wherein said flow throttle means is formed by a peripheral gap between the closure means and the aperture.

5. The water carbonation system as recited in claim 1, wherein said closure means has a disk-shaped valve plate and a stem, said stem sliding axially in the aperture as the closure means moves between the open and closed positions.

6. The water carbonation system as recited in claim 5, wherein said valve plate has a packing ring for securely sealing the aperture when the closure means is in the closed position, and said packing ring being made from elastically deformable material.

7. The water carbonation system as recited in claim 6, wherein said valve plate faces a valve seat surrounding said aperture, said valve seat having a conical shape.

8. The water carbonation system as recited in claim 1, wherein said valve assembly is integrated into a pressure regulator in the means for introducing gas into the tank.

9. The water carbonation system as recited in claim 1, and further comprising means to cool said tank.

10. The water carbonation system as recited in claim 1, wherein a signal is provided to alert an operator when the pressure in the tank reaches the second pressure and the closure means moves from the closed to the open position.

* * * * *